United States Patent [19]

Buche

[11] 4,402,385

[45] Sep. 6, 1983

[54] FOLDING STEP

[76] Inventor: Peter J. Buche, 262 Cardinal Leger, Pincourt, Quebec, Canada, J7V 3Y7

[21] Appl. No.: 267,689

[22] Filed: May 28, 1981

[51] Int. Cl.[3] ..... E06C 7/08; E06C 9/04

[52] U.S. Cl. ..... 182/91; 182/92

[58] Field of Search ..... 182/92, 91, 87, 90; 280/163, 166, 164 R, 164 A, 165, 169; 248/222.2, 222.3

[56] References Cited

U.S. PATENT DOCUMENTS

| | | | |
|---|---|---|---|
| 770,205 | 9/1904 | Warren | 182/92 |
| 865,375 | 9/1907 | Frye | 182/91 |
| 1,953,298 | 4/1934 | Goodwin | 182/91 |
| 2,745,703 | 5/1956 | Rose | 182/91 |

FOREIGN PATENT DOCUMENTS

| | | | |
|---|---|---|---|
| 656198 | 1/1963 | Canada | 248/222.2 |
| 17121 | of 1908 | United Kingdom | 182/91 |

*Primary Examiner*—Reinaldo P. Machado
*Assistant Examiner*—Alvin Chin-Shue
*Attorney, Agent, or Firm*—Watson, Cole, Grindle & Watson

[57] ABSTRACT

A folding step having a mounting plate and a step member. The mounting has a back face and a front face and is adapted to be mounted against a surface to be climbed with its back face flush against the surface. A recess is provided in the back of the plate and an opening extends through the plate between the recess and the front face. The step member is mounted through the opening from the recess. Cooperating means are provided on the plate and step member for preventing the step member from passing completely through the opening from the recess. The step member is movable in the opening between a horizontal operative position where it projects transversely from the front face of the mounted plate, and an upright stored position where it lies generally parallel to, and against, the plate.

3 Claims, 12 Drawing Figures

FOLDING STEP

This invention is directed toward an improved folding step.

Folding steps are employed on walls or poles for use in climbing. The folding steps are used to replace fixed projecting steps attached to a surface to be climbed to provide a neater appearance and/or to minimize unauthorized climbing of the surface. Examples of folding steps are shown in U.S. Pat. Nos. 1,419,563 and 2,158,949.

The known folding steps have several disadvantages however. Often, the surface on which the steps are to be mounted must be provided with apertures to receive a portion of the step in order to provide a flush mounting (see U.S. Pat. No. 1,419,563). The need for such apertures makes the steps more expensive. The step portion and the mounting portion of the folding step must also normally be permanently joined together to prevent the loss of the step portion. This is normally done with a hinge pin (see U.S. Pat. No. 2,158,949) or with a retaining member fixed during installation to the mounting portion (see U.S. Pat. No. 1,419,563). The extra elements and time required to join the step and mounting portions together adds additional expense, and complicates the structures. The known folding steps are also not well suited for use aboard a sailing ship because they have an angular, projecting construction and/or do not mount as flush against a surface as is desirable. As a result, the ropes on a sailing ship can become entangled on the steps when they are folded, or can severely chaff in rubbing on the steps.

It is therefore the purpose of the present invention to provide an improved folding step which eliminates, or at least minimizes, many of the disadvantages of known folding steps while retaining their advantages. More particularly, it is one purpose of the present invention to provide an improved folding step which employs a minimum number of parts, but which parts are securely retained together when the step is installed. It is a further purpose of the present invention to provide an improved folding step which is compact and streamlined when in the inoperative position thereby minimizing chaffing and/or entanglement of ropes with the steps when used on board sailing ships.

In accordance with the preferred embodiment of the present invention there is provided a folding step consisting of only two parts—a mounting plate adapted to be mounted flush against a surface to be climbed, a step member operatively associated with the mounting plate. A recess or cutout is provided in the back of the plate. An opening extends through the plate from the recess. The step member is adapted to project through the opening from the recess when the plate is mounted on the surface. Cooperating means are provided on the plate and the step member for preventing the step member from being pulled completely through the opening from the recess. The step member can move in the opening between an operative, horizontal position, where it is used as a step, and a stored, upright position relative to the plate. The plate member is smoothly contoured to minimize snagging and the step member rests flush against the plate when in the stored position, within a second recess on the front of the plate.

The invention is particularly directed toward a folding step having a mounting plate, with a front and back face, and a step member. Means are provided on the mounting plate for use in fixing the mounting plate to a surface to be climbed with the back face substantially flush against the surface. A recess is provided in the back of the mounting plate. An opening extends through the mounting plate between the front face and the recess. The step member is adapted to extend through the opening from the recess. Cooperating means are provided on the plate and step member for preventing the step member from being pulled completely from the recess through the opening.

The invention will now be described in detail having reference to the accompanying drawings in which.

Figure 1:
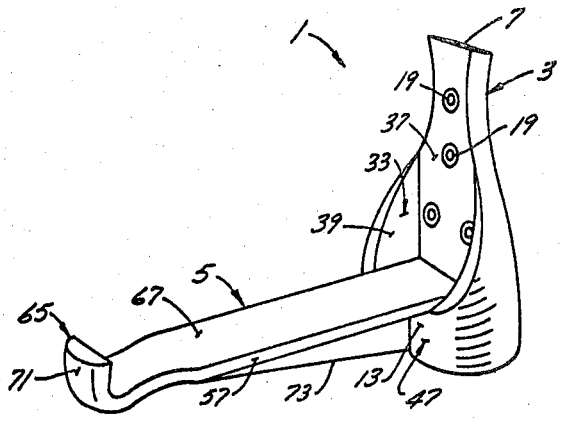
FIG. 1 is a perspective view of the folding step in an operative position.
Figure 2:
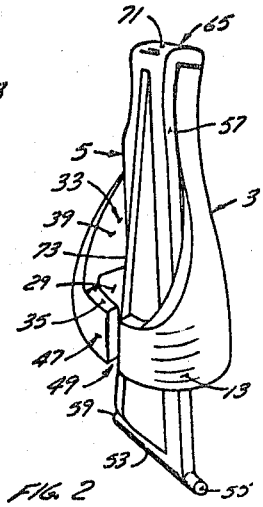
FIG. 2 is a perspective view of the folding step in a stored position.
Figure 8:
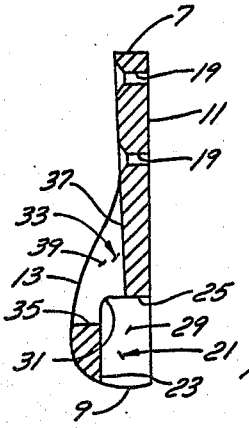
FIG. 8 is a cross-section view of the mounting plate taken along line 8—8 of FIG. 7.
Figure 10:
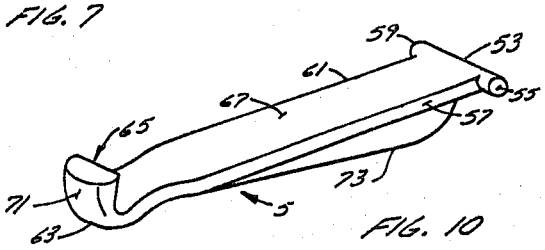
FIG. 10 is a perspective view of the step member.
Figure 11:
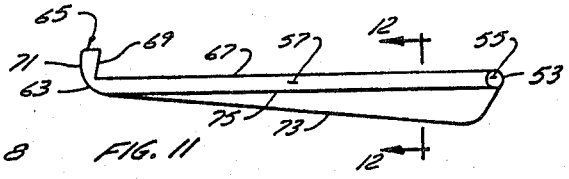
FIG. 11 is a side view of the step member.

The folding step 1 of the present invention comprises a mounting plate 3 and a separate step member 5 as shown in FIG. 1. The mounting plate 3, as shown in FIGS. 5 to 9 preferably is generally pear-shaped with a flat, narrow top end 7 and a slightly curved, wide bottom end 9. The back face 11 of the plate is usually flat and the front face 13 curves outwardly near the bottom end as shown in FIG. 8. The sides and bottom portions of the front face 13 are rounded to curve smoothly toward the back face 11.

Figure 3:
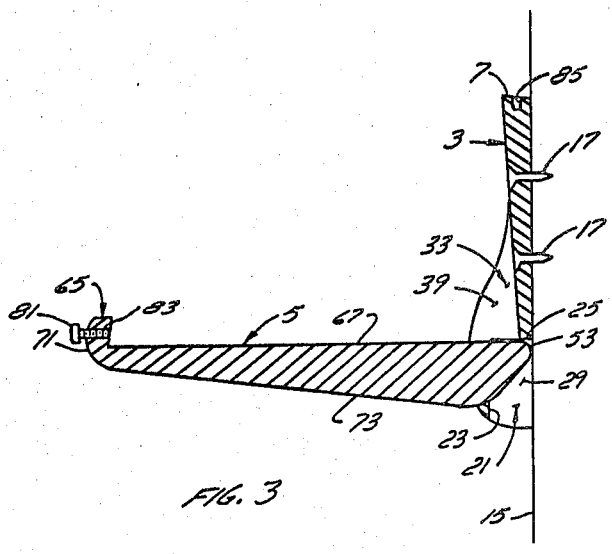
FIG. 3 is a cross-section view of the folding step in an operative position.
Figure 4:
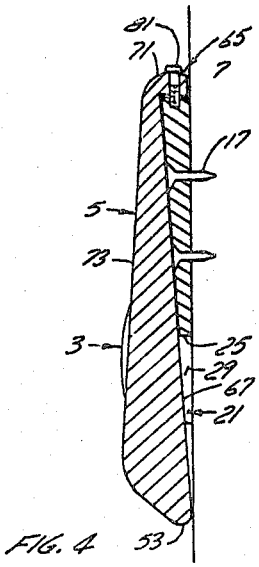
FIG. 4 is a cross-section view of the folding step in a stored position.
Figure 5:
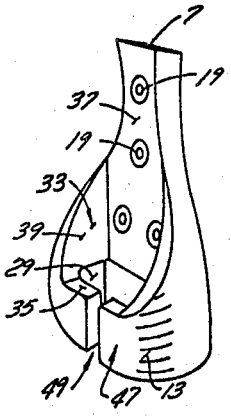
FIG. 5 is a perspective view of the mounting plate.
Figure 7:
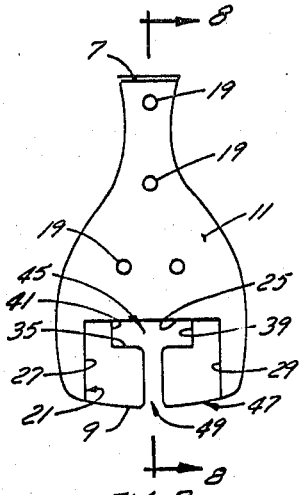
FIG. 7 is a rear view of the mounting plate.

The mounting plate 3 is adapted to be fastened to a surface 15 with its back face 11 generally flush against the surface 15 as shown in FIG. 3. The surface 15 can form part of a wall, a pole, or a mast. If the mounting surface 15 is curved, the back face 11 of the plate 3 can be curved as well to match the curvature of the mounting surface to provide a flush attachment. The mounting plate 3 is adapted to be mounted on the surface 15 by fasteners 17. The fasteners 17 pass through holes 19 in the plate, from its front face 13, to penetrate the mounting surface 15.

A first cutout or recess 21 extends into the mounting plate 3 from its back face 11. The recess 21 preferably extends upwardly from the bottom end 9 of the plate 3 and is defined by: a front surface 23, parallel to the back face 11; a top surface 25, perpendicular to the back face 11; and two parallel side surfaces 27, 29. The corner 31 joining the front and top surfaces 23, 25 preferably is rounded as shown in FIG. 8.

A second cutout or recess 33 extends into the mounting plate 3 from its front face 13. The second cutout 33 extends downwardly and slightly inwardly and intersects the first recess 21, ending in a flat bottom surface 35 which is parallel to the top surface 25 of the first recess 21 but spaced slightly below it. The second recess 33 is further defined by a flat back surface 37, which extends inwardly at a slight angle compared to the back face 11 of the plate 3; and by parallel side surfaces 39,41. Both recesses 21, 33 are centrally located with respect to the vertical center line of plate 3. Second recess 33 is also slightly narrower than first recess 21.

Figure 6:
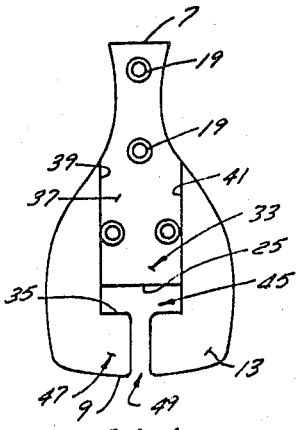
FIG. 6 is a front view of the mounting plate.
Figure 9:
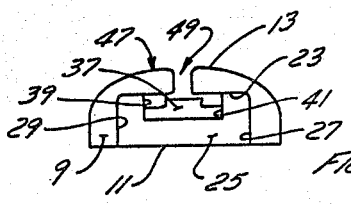
FIG. 9 is a bottom view of the mounting plate.
Figure 12:
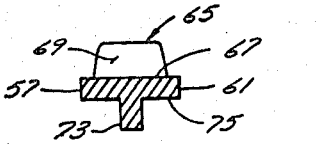
FIG. 12 is a cross-section view taken along line 12—12 of FIG. 11.

An opening 45 is formed in the plate 3 where the two recesses 21, 33 intersect. The opening 45 has a rectangular shape when the plate 3 is viewed from the back side, as shown in FIG. 6, the shape defined by top surface 25, bottom surface 35, and side surfaces 39, 41. The opening 45 has a similar rectangular shape when the plate 3 is viewed from the bottom end, as shown in FIG. 9 the shape defined by front surface 23, back surface 37, and side surfaces 39, 41. The two recesses 21, 33 also define a support cross-bar 47 at the bottom, front portion of the plate 3. Preferably, a central, vertical slot 49 divides the cross-bar 47 in two.

The separate step member 5, which cooperates with the mounting plate 3 to form the folding step 1, is elongated, with a generally rectangular cross-sectional shape slightly smaller than the rectangular shapes of the opening 45 when the opening is viewed from either the back or the bottom of the plate. First retaining means are provided adjacent one end 53 of the step member 5. These retaining means comprise a first projection 55 extending laterally from one side 57 of the member, and a second projection 59 extending laterally from the other side 61 of the member. The projections 55, 59 are aligned and preferably rounded. The distance between the free ends of the projections 55, 59 is less than the distance between the sides 27, 29 of first recess 21, but greater than the distance between the two sides 39, 41 of the second recess 33.

Second retaining means are provided at the other end 63 of the member 5. These second retaining means comprise a short flange 65 extending up from the top side 67 of the member. The flange 65 has a length slightly less than the thickness of the plate 3 at its top end 7. The inner side 69 of the flange 65 is flat and preferably slants inwardly slightly. The outer side 71 of the flange is rounded. If needed, a central stiffening rib 73 can be provided on the bottom side 75 of the member 5, the rib 73 having its greatest depth adjacent end 53 and tapering toward the other end 63 of the member 5.

To install the step 1, the other end 63 of the step member 5 is first passed through opening 45 from the back of member 3 until the first retaining means 55, 59 abut the front surface 23 of the first recess 21 to restrain the member 5 from passing completely through the opening 45. In this position, the one end 53 of the step member 5 is located within the first recess 21. The step member 5 is then positioned to extend generally perpendicular to the plate member 3 while extending through the opening 45. The plate member 3 carrying step member 5, is then positioned in an upright position flush against the vertical mounting surface 15, and fastened thereto by the fasteners 17. The step member 5 now remains in cooperative relationship with the fastened plate member 3, while movable between operative and stored positions, and cannot be separated from the plate member 3.

In the operative position, the step member 5 extends in cantilever fashion generally horizontal and perpendicular to the plate 3. It rests, via its bottom surface 75, on the top of support bar 47, on support surface 35, near its one or inner end 53. The stiffening rib 73 is located within the slot 45. The step member is retained in a horizontal position on the support bar 47 by its upper surface 67, adjacent inner end 53, bearing againt the top surface 25 of the cutout 21 which surface acts as a locating and stop surface. The step member 5 is generally wide enough and long enough to be comfortably stepped on. The upright flange 65 at the other, outer end 63 of the step member 5 helps retain a foot on the step member, preventing it from slipping off the end 63. If desired, the top surface 67 of the step member can be ridged or grooved to provide better traction. When the step member 5 is stepped on, the support bar 47 and stop surface 25 cooperate to carry the load and retain the step member in a horizontal, supportive position.

When the step 1 is not required, the step member 5 is pivoted upwardly about stop surface 25 to move into recess 33. As the step member 5 nears a vertical position it is also moved downwardly relative to both recesses 33,21 until the flange 65 rests on the top 7 of the plate 3. The step member 5 is then in its stored position with its top surface 67 flush against the back surface 37 of the second recess 33 in the plate 3. Since the back surface 37 slopes slightly inwardly, so does step member 5 with its inner end 53 being cammed into the mounting surface 15 by the cross-bar 47 as it moves down to help secure the step member in its stored position. The top end 7 of the plate 3 preferably slopes down slightly from front to back so that the slanted inner face 69 of flange 65 will rest flush on it. In the stored position, the step 1 lies closely adjacent the mounting surface 15 and presents a generally smooth, clean appearance. If desired a screw 81 can be inserted through a threaded hole 83 in the flange 65 on the step member 5 and screwed into a hole 85 in the top end 7 of plate member 3, to securely hold the step member 5 in an inoperative position and thus minimize unauthorized use of the steps.

In the operative position, the pin-like lateral projections 55, 59 on the step member 5 at its inner end 53 abut against the front surface 23 of recess 21, adjacent opening 45, preventing complete withdrawal of the step member 5 from the attached plate 3 through opening 45. As the step member 5 is moved upwardly toward a stored position the projections 55, 59 abut against the corner 31 and top surface 25 of recess 21, thereby still preventing withdrawal of the step member 5 through opening 45. The mounting surface 15 prevents the step member 5 from being withdrawn back through opening 45 even with the step member 5 in a stored upright position since surface 37 of the plate and cross-bar 47 cams the lower end 53 of the member 5 against the surface 15. In addition, flange 65 on member 5 cooperates with the top end 7 of the plate to prevent downward withdrawal of the member 5 from plate 3.

I claim:

1. A folding step comprising a mounting plate and a step member wherein:

said mounting plate has a front face and a back face, means on the back face for use in fixing the mounting plate to a vertical surface to be climbed, said mounting plate having an upper surface angled downwardly towards the surface to which the plate is to be mounted, a first recess in the back of the mounting plate, a second recess in the front of the mounting plate, the first and second recesses intersecting to form an opening through the plate, said opening extending through the top and bottom of the plate, said front face forming a support cross-bar, said front face having a centrally located elongated vertical slot therein, said slot being continuous from the top of said front face to the bottom thereof;

said step member having an elongated upper face, co-operating means at a first end of said face for retaining said step member in said first recess when said step member is in an operative position, an upwardly extending flange extending from an opposed second end of said upper face of said step member, said flange being angled inwardly such that said flange will seat on said downwardly angled upper surface of said mounting plate when in a stored position to thereby securely retain the step member in the storage position.

2. The folding step as claimed in claim 1 wherein the first recess is wider than the second recess and the co-operating means comprises a surface adjacent the opening defining part of the first recess and lateral projecting means on the step member co-operating with the surface.

3. A folding step as claimed in claim 1 wherein said step member has a reinforcing flange extending downwardly from a lower surface of said face, said flange adapted to fit within said vertical slot of the front face of said mounting plate.

* * * * *